US008485279B2

(12) United States Patent
Tibbitts et al.

(10) Patent No.: US 8,485,279 B2
(45) Date of Patent: Jul. 16, 2013

(54) IMPACTOR EXCAVATION SYSTEM HAVING A DRILL BIT DISCHARGING IN A CROSS-OVER PATTERN

(75) Inventors: Gordon A. Tibbitts, Murray, UT (US); Greg Galloway, Conroe, TX (US); Jim B. Terry, Houston, TX (US)

(73) Assignee: PDTI Holdings, LLC, Houston, TX (US)

( * ) Notice: Subject to any disclaimer, the term of this patent is extended or adjusted under 35 U.S.C. 154(b) by 482 days.

(21) Appl. No.: 12/752,897

(22) Filed: Apr. 1, 2010

(65) Prior Publication Data

US 2010/0294567 A1 Nov. 25, 2010

Related U.S. Application Data

(60) Provisional application No. 61/167,782, filed on Apr. 8, 2009.

(51) Int. Cl.
*E21B 7/18* (2006.01)

(52) U.S. Cl.
USPC ..... 175/54; 175/67; 175/424

(58) Field of Classification Search
USPC ..... 175/54, 67, 424
See application file for complete search history.

(56) References Cited

U.S. PATENT DOCUMENTS

| | | | |
|---|---|---|---|
| 2,626,779 | A | 1/1953 | Amnentrout |
| 2,724,574 | A | 11/1955 | Ledgerwood, Jr. |
| 2,727,727 | A | 12/1955 | Williams |
| 2,728,557 | A | 12/1955 | McNatt |
| 2,761,651 | A | 9/1956 | Ledgerwood, Jr. |
| 2,771,141 | A | 11/1956 | Lewis |
| 2,779,571 | A | 1/1957 | Ortloff |
| 2,807,442 | A | 9/1957 | Ledgerwood, Jr. |
| 2,809,013 | A | 10/1957 | Ledgerwood, Jr. et al. |
| 2,815,931 | A | 12/1957 | Williams |
| 2,841,365 | A | 7/1958 | Ramsey et al. |
| 2,868,509 | A | 1/1959 | Williams |
| 2,954,122 | A | 9/1960 | Colburn |

(Continued)

FOREIGN PATENT DOCUMENTS

| | | | |
|---|---|---|---|
| CA | 2522568 | A1 | 11/2004 |
| CA | 2588170 | A1 | 5/2007 |

(Continued)

OTHER PUBLICATIONS

Co-pending U.S. Appl. No. 12/363,022, filed Jan. 30, 2009, Tibbitts et al.

(Continued)

*Primary Examiner* — David Andrews
*Assistant Examiner* — Robert E Fuller
(74) *Attorney, Agent, or Firm* — Vedder Price P.C.

(57) ABSTRACT

A system for use in excavating a wellbore that includes a drill string and attached drill bit that has nozzles that are in fluid communication with the drill string. The system receives pressurized slurry of fluid and impactor particles and directs the slurry at a subterranean formation from the nozzles to form the wellbore. Discharge streams are formed from the slurry exiting the nozzles, the discharge streams impact and fracture the formation to remove material. The nozzles are oriented so that the streams excavate in the middle and periphery of the borehole bottom. The nozzles can be oriented to form frusto-conical spray patterns when the bit is rotated, wherein the spray patterns can intersect or overlap.

23 Claims, 14 Drawing Sheets

U.S. PATENT DOCUMENTS

| | | | | | |
|---|---|---|---|---|---|
| 3,001,652 | A | | 9/1961 | Schroeder et al. | |
| 3,055,442 | A | | 9/1962 | Prince | |
| 3,084,752 | A | | 4/1963 | Tiraspolsky | |
| 3,093,420 | A | | 6/1963 | Levene et al. | |
| 3,112,800 | A | | 12/1963 | Bobo | |
| 3,123,159 | A | | 3/1964 | Buck | |
| 3,132,852 | A | | 5/1964 | Dolbear | |
| 3,322,214 | A | | 5/1967 | Buck | |
| 3,374,341 | A | | 3/1968 | Klotz | |
| 3,380,475 | A | | 4/1968 | Armstrong | |
| 3,385,386 | A | | 5/1968 | Goodwin et al. | |
| 3,389,759 | A | | 6/1968 | Mori et al. | |
| 3,416,614 | A | | 12/1968 | Goodwin et al. | |
| 3,424,255 | A | | 1/1969 | Mori et al. | |
| 3,469,642 | A | | 9/1969 | Goodwin et al. | |
| 3,542,142 | A | | 11/1970 | Hasiba et al. | |
| 3,548,959 | A | | 12/1970 | Hasiba et al. | |
| 3,560,053 | A | | 2/1971 | Ortloff | |
| 3,576,221 | A | | 4/1971 | Hasiba | |
| 3,645,346 | A | | 2/1972 | Miller et al. | |
| 3,667,557 | A | | 6/1972 | Todd et al. | |
| 3,688,852 | A | | 9/1972 | Gaylord et al. | |
| 3,688,859 | A | | 9/1972 | Maurer | |
| 3,704,966 | A | | 12/1972 | Beck, Jr. | |
| 3,831,753 | A | | 8/1974 | Gaylord et al. | |
| 3,838,742 | A | | 10/1974 | Juvkam-Wold | |
| 3,852,200 | A | | 12/1974 | Meyer | |
| 3,865,202 | A | | 2/1975 | Takahashi et al. | |
| 3,924,698 | A | | 12/1975 | Juvkam-Wold | |
| 3,960,407 | A | * | 6/1976 | Noren | 299/17 |
| 4,042,048 | A | | 8/1977 | Schwabe | |
| 4,067,617 | A | | 1/1978 | Bunnelle | |
| 4,141,592 | A | | 2/1979 | Lavon | |
| 4,266,621 | A | | 5/1981 | Brock | |
| 4,304,609 | A | | 12/1981 | Morris | |
| 4,337,899 | A | * | 7/1982 | Selberg | 239/543 |
| 4,361,193 | A | | 11/1982 | Gravley | |
| 4,391,339 | A | | 7/1983 | Johnson, Jr. et al. | |
| 4,444,277 | A | | 4/1984 | Lewis | |
| 4,476,027 | A | | 10/1984 | Fox | |
| 4,490,078 | A | | 12/1984 | Armstrong | |
| 4,495,227 | A | | 1/1985 | Tanaka | |
| 4,497,598 | A | | 2/1985 | Blanton | |
| 4,498,987 | A | | 2/1985 | Inaba | |
| 4,534,427 | A | | 8/1985 | Wang et al. | |
| 4,624,327 | A | | 11/1986 | Reichman | |
| 4,627,502 | A | | 12/1986 | Dismukes | |
| 4,681,264 | A | | 7/1987 | Johnson | |
| 4,699,548 | A | | 10/1987 | Bergstrom | |
| 4,768,709 | A | | 9/1988 | Yie | |
| 4,809,791 | A | | 3/1989 | Hayatdavoudi | |
| 4,825,963 | A | | 5/1989 | Ruhle | |
| 4,852,668 | A | | 8/1989 | Dickinson, III et al. | |
| 5,199,512 | A | | 4/1993 | Curlett | |
| 5,255,959 | A | * | 10/1993 | Loegel | 299/17 |
| 5,291,957 | A | | 3/1994 | Curlett | |
| 5,355,967 | A | | 10/1994 | Mueller et al. | |
| 5,380,068 | A | * | 1/1995 | Raghavan | 299/17 |
| 5,421,420 | A | | 6/1995 | Malone et al. | |
| 5,542,486 | A | | 8/1996 | Curlett | |
| 5,718,298 | A | | 2/1998 | Rusnak | |
| 5,799,734 | A | | 9/1998 | Norman et al. | |
| 5,862,871 | A | | 1/1999 | Curlett | |
| 2,881,830 | A | | 3/1999 | Cooley | |
| 5,897,062 | A | | 4/1999 | Enomoto et al. | |
| 5,944,123 | A | | 8/1999 | Johnson | |
| 6,003,623 | A | | 12/1999 | Miess | |
| 6,142,248 | A | | 11/2000 | Thigpen et al. | |
| 6,152,356 | A | | 11/2000 | Minden | |
| 6,216,801 | B1 | | 4/2001 | Jonnes | |
| 6,345,672 | B1 | | 2/2002 | Dietzen | |
| 6,347,675 | B1 | | 2/2002 | Kolle | |
| 6,386,300 | B1 | | 5/2002 | Curlett et al. | |
| 6,474,418 | B2 | | 11/2002 | Miramon | |
| 6,506,310 | B2 | | 1/2003 | Kulbeth | |
| 6,530,437 | B2 | | 3/2003 | Maurer et al. | |
| 6,533,946 | B2 | | 3/2003 | Pullman | |
| 6,571,700 | B2 | | 6/2003 | Nakamura et al. | |
| 6,581,700 | B2 | | 6/2003 | Curlett et al. | |
| 6,601,650 | B2 | | 8/2003 | Sundararajan | |
| 6,732,797 | B1 | | 5/2004 | Watters et al. | |
| 6,904,982 | B2 | | 6/2005 | Judge et al. | |
| 6,920,945 | B1 | | 7/2005 | Belew et al. | |
| 7,090,017 | B2 | | 8/2006 | Justus et al. | |
| 7,172,038 | B2 | | 2/2007 | Terry et al. | |
| 7,258,176 | B2 | | 8/2007 | Tibbitts et al. | |
| 7,343,987 | B2 | | 3/2008 | Tibbitts | |
| 7,383,896 | B2 | | 6/2008 | Tibbitts | |
| 7,398,838 | B2 | | 7/2008 | Harder et al. | |
| 7,398,839 | B2 | | 7/2008 | Harder et al. | |
| 7,503,407 | B2 | | 3/2009 | Tibbitts | |
| 7,757,786 | B2 | | 7/2010 | Harder et al. | |
| 7,793,741 | B2 | | 9/2010 | Harder et al. | |
| 7,798,249 | B2 | | 9/2010 | Tibbitts | |
| 2002/0011338 | A1 | | 1/2002 | Maurer et al. | |
| 2002/0134550 | A1 | | 9/2002 | Leeson et al. | |
| 2006/0011386 | A1 | | 1/2006 | Tibbitts | |
| 2006/0016622 | A1 | | 1/2006 | Tibbitts | |
| 2006/0016624 | A1 | | 1/2006 | Tibbitts | |
| 2006/0021798 | A1 | | 2/2006 | Tibbitts | |
| 2006/0027398 | A1 | | 2/2006 | Tibbitts | |
| 2006/0124304 | A1 | | 6/2006 | Bloess et al. | |
| 2006/0180350 | A1 | | 8/2006 | Harder | |
| 2006/0191717 | A1 | | 8/2006 | Harder et al. | |
| 2006/0191718 | A1 | | 8/2006 | Harder et al. | |
| 2008/0017417 | A1 | | 1/2008 | Tibbits | |
| 2008/0135300 | A1 | | 6/2008 | James | |
| 2008/0156545 | A1 | | 7/2008 | Tibbitts | |
| 2008/0196944 | A1 | | 8/2008 | Tibbitts | |
| 2008/0210472 | A1 | | 9/2008 | Tibbitts | |
| 2008/0230275 | A1 | | 9/2008 | Harder | |
| 2009/0038856 | A1 | | 2/2009 | Vuyk | |
| 2009/0090557 | A1 | | 4/2009 | Vuyk, Jr. et al. | |
| 2009/0126994 | A1 | | 5/2009 | Tibbitts et al. | |
| 2009/0200080 | A1 | | 8/2009 | Tibbitts | |
| 2009/0200084 | A1 | | 8/2009 | Vuyk | |
| 2009/0205871 | A1 | | 8/2009 | Tibbitts | |
| 2009/0218098 | A1 | | 9/2009 | Tibbitts et al. | |
| 2009/0223718 | A1 | | 9/2009 | Tibbitts | |

FOREIGN PATENT DOCUMENTS

| | | | |
|---|---|---|---|
| EP | 0192016 | A1 | 8/1986 |
| GB | 2385346 | A | 8/2003 |
| GB | 2385346 | B | 9/2004 |
| WO | 0225053 | A1 | 3/2002 |
| WO | 0234653 | A | 5/2002 |
| WO | 02092956 | A | 11/2002 |
| WO | 2004094734 | A2 | 11/2004 |
| WO | 2004106693 | A2 | 12/2004 |
| WO | 2006019977 | A3 | 2/2006 |
| WO | 2009009792 | | 1/2009 |
| WO | 2009049076 | A1 | 4/2009 |
| WO | 2009065107 | A1 | 5/2009 |
| WO | 2009099945 | A2 | 8/2009 |

OTHER PUBLICATIONS

Co-pending U.S. Appl. No. 12/271,514, filed Nov. 14, 2008, Tibbitts et al.

Co-pending U.S. Appl. No. 12/248,649, filed Oct. 10, 2009, Vuyk Jr. et al.

Co-pending U.S. Appl. No. 12/120,763, filed May 15, 2008, Tibbits.

Co-pending U.S. Appl. No. 11/204,862, filed Aug. 16, 2005, Tibbitts.

Co-pending U.S. Appl. No. 12/796,377, filed Jun. 8, 2010, Harder et al.

Co-pending U.S. Appl. No. 11/773,355, filed Jul. 3, 2007, Vuyk Jr. et al.

Co-pending U.S. Appl. No. 12/641,720, filed Dec. 18, 2009, Tibbitts et al.

Co-pending U.S. Appl. No. 12/752,897, filed Apr. 1, 2010, Tibbitts.

Co-pending U.S. Appl. No. 11/058,181, filed Nov. 22, 2005, Tibbitts.

Co-pending U.S. Appl. No. 11/801,268, filed May 9, 2007, Tibbitts et al.

Co-pending U.S. Appl. No. 12/033,829, filed Feb. 19, 2008, Tibbitts.

Co-pending U.S. Appl. No. 12/172,760, filed Jul. 14, 2008, Vuyk, Jr. et al.

Co-pending U.S. Appl. No. 12/388,289, filed Feb. 19, 2009, Tibbitts.
*Curlett Family Limited Partnership, Ltd*., Plaintiff v. *Particle Drilling Technologies, Inc*., a Delaware Corporation; and Particle Drilling Technologies, Inc., a Nevada Corporation; Affidavit of Harry (Hal B. Curlett,; May 3, 2006, 8 pages.
Geddes et al., "Leveraging a New Energy Source to Enhance Heavy-Oil and Oil-Sands Production," Society of Petroleum Engineers, SPE/PS-CIM/CHOA 97781, 2005, 7 pages.
www.particledrilling.com, May 4, 2006, 75 pages.
Anderson, Arthur, "Global E&P Trends" Jul. 1999, 2 pages.
Cohen et ai, "High-Pressure Jet Kerf Drilling Shows Significant Potential to Increase Rap", SPE 96557, Oct. 2005, pp. 1-8.
Eckel, et al., "Development and Testing of Jet Pump Pellet Impact Drill Bits," Petroleum Transactions, Aime, 1956, 1-10, vol. 207, pp. 1-10.
Fair, John, "Development of High-Pressure Abrasive-Jet Drilling", Journal of Petroleum Technology, Aug. 1981, pp. 1379-1388.
Galecki et al., "Steel Shot Entrained Ultra High Pressure Waterjet for Cutting and Drilling in Hard Rocks", pp. 371-388.
Killalea, Mike, High Pressure Drilling System Triples ROPS, Stymies Bit Wear, Drilling Technology, Mar.-Apr. 1989, pp. 10-12.
Kolle et al., "Laboratory and Field Testing of an Ultra-High-Pressure, Jet-Assisted Drilling System," SPE/ADC 22000, 1991, pp. 847-856.
Ledgerwood, L., "Efforts to Develop Improved Oilwell Drilling Methods," Petroleum Transactions, Aime, 1960, vol. 219, pp. 61-74.
Maurer, William, "Advanced Drilling Techniques," Chapter 5, pp. 19-27, Petroleum Publishing Co., Tulsa, OK. 1980, 11 pages.
Maurer, William, "Impact Crater Formation in Rock," Journal of Applied Physics, Jul. 1960, vol. 31, No. 7, pp. 1247-1252.
Maurer et al., "Deep Drilling Basic Research vol. 1—Summary Report," Gas Research Institute, GRI 9010265.1, Jun. 1990, 59 pages.
Peterson et al., "A New Look at Bit-Flushing or the Importance of the Crushed Zone in Rock Drilling and Cutting," 20 pages.
Ripken et al., "A Study of the Fragmentation of Rock by Impingement with Water and Solid Impactors," University of Minnesota St. Anthony Falls Hydraulic Laboratory, Feb. 1972, 114 pages.
Review of Mechanical Bit/Rock Interactions, vol. 3, pp. 3-1 to 3-68. Security DBS, 1995, 62 pages.
Singh, Madan, "Rock Breakage by Pellet Impact," IIT Research Institute, Dec. 24, 1969, 92 pages.
Summers et al., "A Further Investigation of DIAjet Cutting," Jet Cutting Technology—Proceedings of the 10th International Conference, 1991, Elsevier Science Publishers Ltd, USA, pp. 181-192.
Summers, David, "Waterjetting Technology," Abrasive Waterjet Drilling, Curators' Professor of Mining Engineering and Director High Pressure Waterjet Laboratory University of Missouri-Rolla Missouri, E & FN SPON, London, UK, First Edition 1995 (ISBN 0419196609), pp. 557-598.
Veenhuizen, et al., "Ultra-High Pressure Jet Assist of Mechanical Drilling," SPE/IADC 37579, 1997, pp. 79-90.
International Search Report PCT/US04/11578; dated Dec. 28, 2004, 4 pages.
International Preliminary Report of Patentability PCT/US04/11578; dated Oct. 21, 2005, 5 pages.
Written Opinion PCT/US04/11578; dated Dec. 28, 2004, 4 pages.
International Search Report PCT/US05/25092; Dated Mar. 6, 2006.
Written Opinion PCT/US05/25092; Dated Mar. 6, 2006.
International Preliminary Report on Patentability dated Nov. 19, 2009 on PCT/US08/05955, 5 pages.
International Preliminary Report on Patentability on PCT/US2009/032654 dated Apr. 17, 2009, 6 pages.
International Search Report dated Dec. 30, 2009 on PCT/US2009/032654, 1 page.
File history of European Patent Application No. 04759869.3.
File history of European Patent Application No. 5771403.2.
File history of GCC Patent Application No. 2005/5376.
File history of Iraq Patent Application No. 98/2005.
File history of Norwegian Patent Application No. 20070997.
File history of Venezuelan Patent Application No. 1484-05.
File history of Canadian Patent Application No. 2,588,170.
File history of Canadian Patent Application No. 2,522,568.
File history of Iraq Patent Application No. 34/2004.
File history of Norwegian Patent Application No. 20055409.
File history of GCC Patent Application No. 2004/3659.
International Preliminary Report on Patentability dated Jan. 12, 2010 on PCT/US08/69972, 5 pages.
International Search Report dated Sep. 18, 2008 on PCT/US07/72794, 1 page.
International Preliminary Report on Patentability dated Oct. 9, 2008 on PCT/US08/69972, 5 pages.
Behavior of Suspensions and Emulsion in Drilling Fluids, Nordic Rheology Society,Jun. 14-15, 2007.
Colby, R.H., Viscoelasticity of Structured Fluids, Coporate Research Laboratories, Eastman Kodak Company, Rochester, New York.
Rheo-Plex Product Information Sheet, Scomi Oiltools, 2 pages.
Gelplex Product Information Sheet, Miswaco, 2 pages.
Drilplex Product Information Sheet, Miswaco, 2 pages.
Drilplex System Successfully Mills Casing Windows Offshore Egypt Performance Report. Miswaco, 2 pages.
Drilplex the Versatile Water-Base System With Exceptional Rheological Properties Designed to Lower Costs in a 0 Wide Range of Wells Product Information Sheet, Miswaco, 6 pages.
File history of Canadian Patent Application No. 2,699,122.

* cited by examiner

IMPACTOR EXCAVATION SYSTEM HAVING A DRILL BIT DISCHARGING IN A CROSS-OVER PATTERN

CROSS-REFERENCE TO RELATED APPLICATIONS

This application claims priority to and the benefit of U.S. Provisional Application Ser. No. 61/167,782, filed Apr. 8, 2009, the full disclosure of which is hereby incorporated by reference herein.

BACKGROUND OF THE INVENTION

1. Field of the Invention

The present disclosure relates to the field of oil and gas exploration and production. More specifically, the present disclosure concerns a system and method for subterranean excavation for discharging particles and/or impactors from nozzles for excavating and angling the nozzles.

2. Description of Related Art

Boreholes for producing hydrocarbons within a subterranean formation are generally formed by a drilling system employing a rotating bit on the lower end of a drill string. The drill string is suspended from a derrick which includes a stationary crown block assembly connected to a traveling block via a steel cable that allows movement between the two blocks. The drill string can be rotated by a top drive or Kelly above the borehole entrance. Drilling fluid is typically pumped through the drill string that then exits the drill bit and travels back to the surface in the annulus between the drill string and wellbore inner circumference. The drilling fluid maintains downhole pressure in the wellbore to prevent hydrocarbons from migrating out of the formation cools and lubricates the bit and drill string, cleans the bit and bottom hole, and lifts the cuttings from the borehole. The drilling bits are usually one of a roller cone bit or a fixed drag bit.

Impactors have recently been developed for use in subterranean excavations. In FIG. 1 a schematic example of an impactor excavating system 10 is shown in a partial sectional view. Drilling fluid is provided by a fluid supply 12, a fluid supply line 14 connected to the fluid supply 12 conveys the drilling fluid to a pump 15 where the fluid is pressurized to provide a pressurized drilling circulating fluid. An impactor injection 16 introduces impactors into the fluid supply line 14; inside the fluid supply line 14, the impactors and circulation fluid mix to form a slurry 19. The slurry 19 flows in the fluid supply line 14 to a drilling rig 18 where it is directed to a drill string 20. A bit 22 on the lower end of the drill string 20 is used to form a borehole 24 through a formation 26. The slurry 19 with impactors 17 is discharged through nozzles 23 on the bit 22 and directed to the formation 26. The impactors 17 strike the formation with sufficient kinetic energy to fracture and structurally alter the subterranean formation 26. Fragments are separated from the formation 26 by the impactor 17 collisions. Material is also broken from the formation 26 by rotating the drill bit 22, under an axial load, against the borehole 24 bottom. The separated and removed formation mixes with the slurry 19 after it exits the nozzles 23; the slurry 19 and formation fragments flow up the borehole 20 in an annulus 28 formed between the drill string 24 and the borehole 20. Examples of impactor excavation systems are described in Ser. No. 10/897,196, filed Jul. 22, 2004 and Curlett et al., U.S. Pat. No. 6,386,300; both of which are assigned to the assignee of the present application and both of which are incorporated by reference herein in their entireties.

Shown in FIG. 2 is an example of a prior art drill bit 22 excavating in the borehole 24. The slurry 19 flows through the attached drill string 20 and exits the drill bit 22 to remove formation material from the borehole 24. The slurry 19 and fragmented formation material flow up the annulus 28. Nozzles (not shown) on the bit 22 bottom combined with the drill bit 22 rotation create an outer annular flow path with a concentric circle to form a rock ring 42 on the borehole 24 bottom. FIG. 3 provides an example of a bit 22 having side arms 214A, 214B, side nozzles 200A, 200B, and a center nozzle 202; each nozzle is orientated at an angle with respect to the bit 22 axis. As shown, the center nozzle 202 is angled about 20° away from the drill bit 22 axis, side nozzle 200A is angled about 10° away from the drill bit 22 axis, and side nozzle 200B is angled at about 14° from the drill bit axis. The side nozzles 200A, 200B are depicted on side arm 214A.

Illustrated in FIG. 4, side nozzle 200A is oriented to cut the inner portion of the exterior cavity 46. In this orientation the center nozzle 202 creates an interior cavity 44 wherein the side nozzles 200A, 200B form an exterior cavity 46. The side arms 214A, 214B fit into the exterior cavity 46 unencumbered from uncut portions of rock formation 270. By varying the center nozzle 202 orientation, the interior cavity 44 size can be varied. Similarly, the exterior cavity 46 can be varied by adjusting side nozzle 200A, 200B orientation. Manipulating cavity 44, 46 size can alter the rock ring 42 size thereby affecting the mechanical cutting force required to drill through the borehole 24 bottom. Alternatively, the side nozzles 200A, 200B may be oriented to decrease the amount of the inner wall 46 contacted by the solid material impactors 272. Shown in FIG. 5, a shallower rock ring 42 is formed by increasing the angle of the side nozzle 200A, 200B orientation.

BRIEF SUMMARY OF THE INVENTION

Disclosed herein is a method of excavating a borehole through a subterranean formation, the method can include pumping a supply of drilling fluid with a pump to supply a pressurized drilling circulating fluid to a drill string, adding impactors to the pressurized circulating fluid downstream of the pump to form a pressurized impactor slurry, providing a circulating flow for excavating the borehole by directing the pressurized impactor slurry to the drill string in the borehole that has on its lower end a drill bit with nozzles in fluid communication with the drill string so that the slurry is discharged from the nozzles to form discharge streams. The method can further include rotating the drill bit, orienting a nozzle to direct a first discharge stream at the formation so that the first discharge stream contacts the formation along a first path that is proximate the borehole outer radius, orienting a nozzle to direct a second discharge stream at the formation so that the second discharge stream contacts the formation along a second path, orienting a nozzle to direct a third discharge stream at the formation so that the third discharge stream contacts the formation along a third path that intersects the second path. The second path may be defined along the borehole bottom in a region from about the borehole axis to proximate the borehole outer radius. The nozzles can be angled from about −15° to about 35° with respect to the drill bit axis. The drill bit can be rotated about a line offset from the drill bit axis.

Also disclosed herein is a system for excavating a borehole through a subterranean formation. The system may include a supply of pressurized impactor laden slurry, a drill string in a borehole in communication with the pressurized impactor laden slurry, a drill bit on the drill string lower end, a first nozzle on the drill bit in fluid communication with the drill string and obliquely angled in one plane with respect to the drill bit axis, and a second nozzle on the drill bit in fluid communication with the drill string and obliquely angled in more than one plane with respect to the drill bit axis. A third nozzle may be included on the drill bit in fluid communication with the drill string and obliquely angled in more than one plane with respect to the drill bit axis. In one embodiment, the first nozzle is at an angle of up to about 35° away from the drill bit axis. In an embodiment the second nozzle is at an angle of up to about 12° away from the drill bit axis and at an angle of about 11° lateral to the drill bit axis. In another embodiment the third nozzle is at an angle of up to about 11° away from the drill bit axis and at an angle of about 12° lateral to the drill bit axis.

BRIEF DESCRIPTION OF THE DRAWINGS

FIG. 10A-1 shows the sectional view through which FIG. 10A is taken.

DETAILED DESCRIPTION OF THE ILLUSTRATIVE EMBODIMENTS

Figure 2:
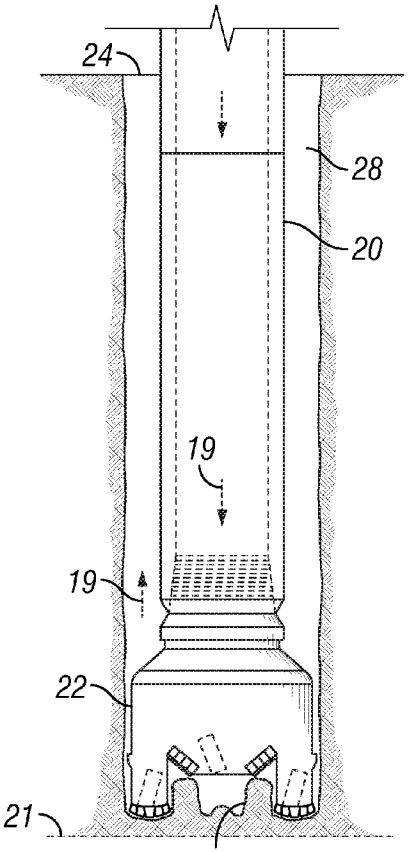
FIG. 2 (Prior Art)
FIG. 2 depicts a side partially sectional view of a drill bit for use with the excavation system of FIG. 1.

In the drawings and description that follows, like parts are marked throughout the specification and drawings with the same reference numerals, respectively. The drawings are not necessarily to scale. Certain features of the disclosure may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results. The various characteristics mentioned above, as well as other features and characteristics described in more detail below, will be readily apparent to those skilled in the art upon reading the following detailed description of the embodiments, and by referring to the accompanying drawings.

Figure 6:
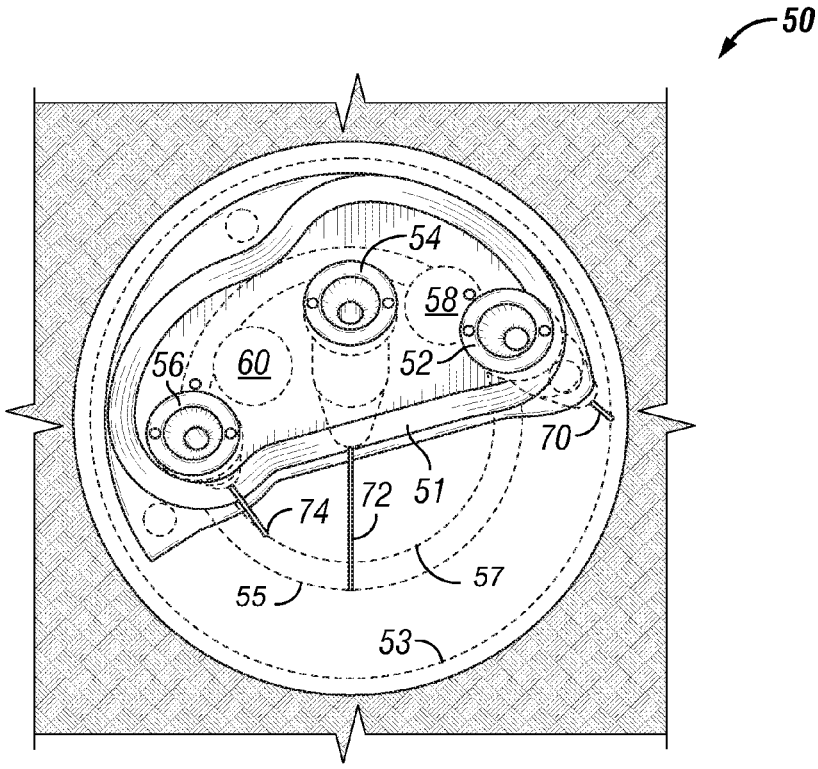
FIG. 6 is an overhead view of an excavating bit in accordance with the present disclosure.
Figure 7A:
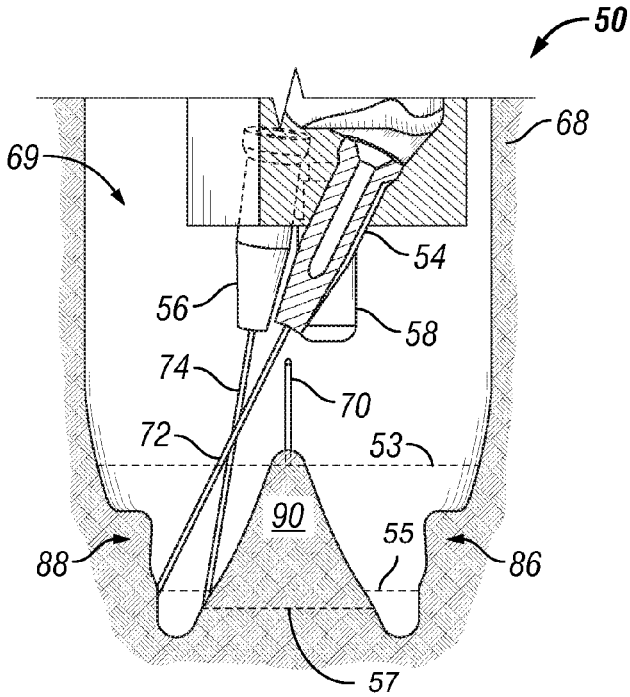
FIGS. 7A-7F illustrate side sectional views of the bit of FIG. 6.
Figures 1, 7A:
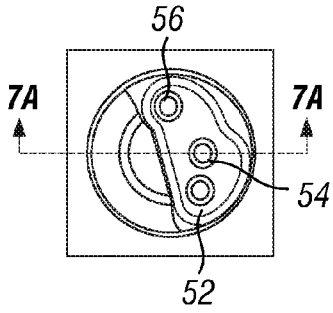

A bit 50 embodiment is depicted in FIG. 6 having an outer nozzle 52, a middle nozzle 54, and a center nozzle 56. The middle nozzle 54 is shown creating a flow path 72 circumscribing a middle nozzle flow path 74 formed by the center nozzle 56. FIGS. 7A through 7E depict sectional views taken along lines provided in a graphic adjacent each sectional view. Referring now to FIG. 7A, a sectional view is (taken along line 7A-7A of FIGS. 7A-1) showing the middle nozzle 54 in section and the center nozzle 56 in side view. The nozzle arrangement of FIG. 7A forms a profile 86 on the wellbore 69 bottom having a channel 88 formed proximate to the borehole 69 outer diameter and a formed rock cone 90 in the borehole 69 bottom middle portion. Sectional view 7B (taken along lines 7B-7B of FIGS. 7B-1) shows the nozzles 52, 54, 56 and profile 86 in sectional view. Discharges 70, 72, 74 from the nozzles 52, 54, 56 contact and excavate on the borehole 69 bottom to form the profile 86. In an example nozzle test carrier, bumpers 58, 60 are provided on the bit 50 to prevent the nozzles 52, 54, 56 from contacting the formation 68, although such bumpers are not generally used in an actual bit. In the embodiment of FIG. 7A, the wellbore 69 is excavated by contact from the nozzle discharges 70, 72, 74. Optionally, cutters (not shown) could be provided so that when rotating the bit 50 will remove any rock remaining as the bit 50 is moved downward.

Figure 7B:
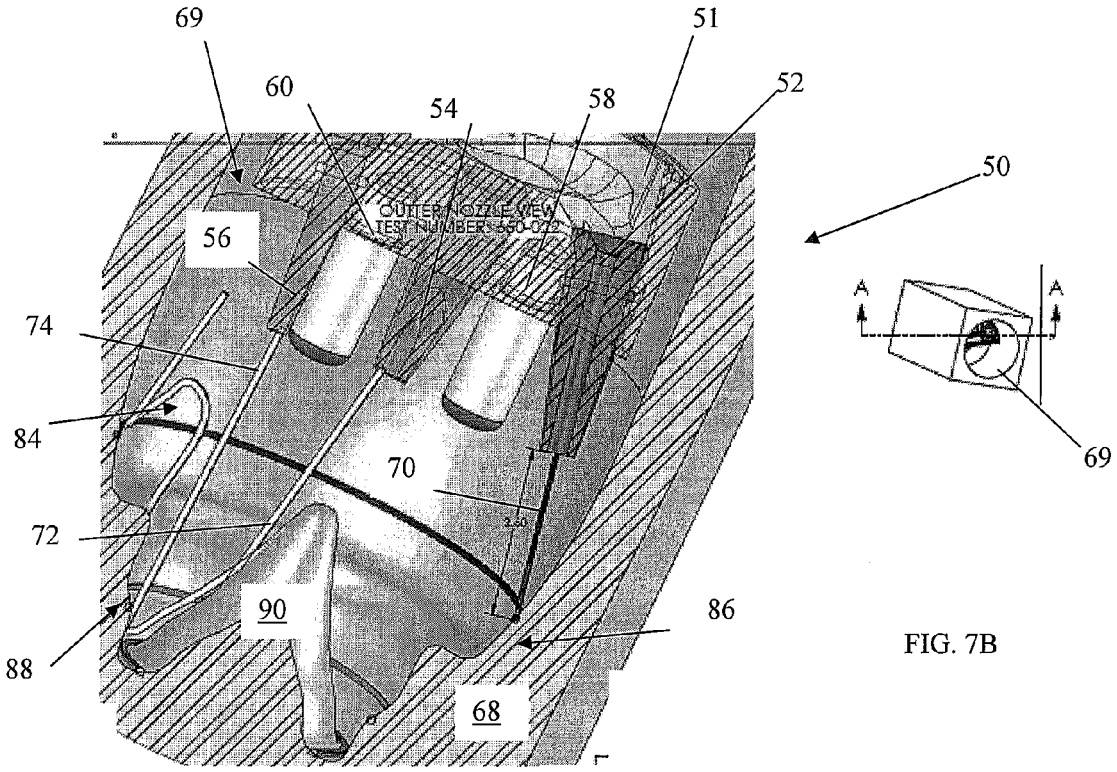
Figure 7C:
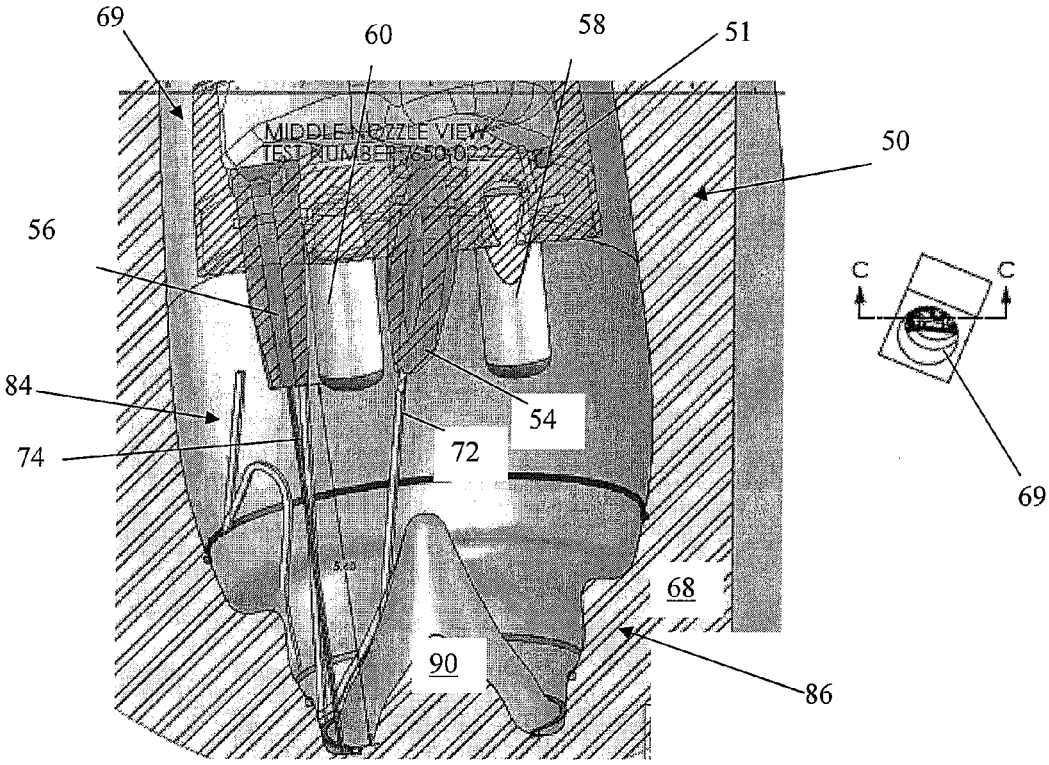
Figure 7D:
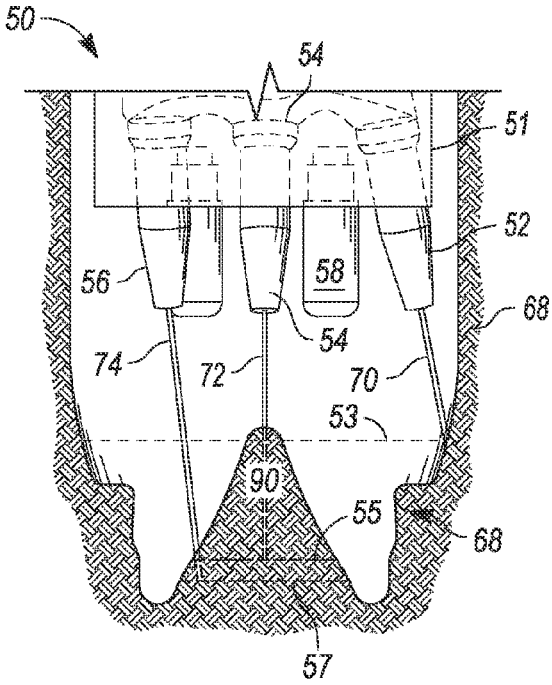
Figures 1, 7D:
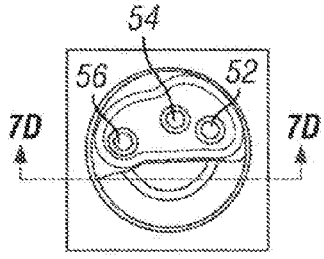
Figure 7E:
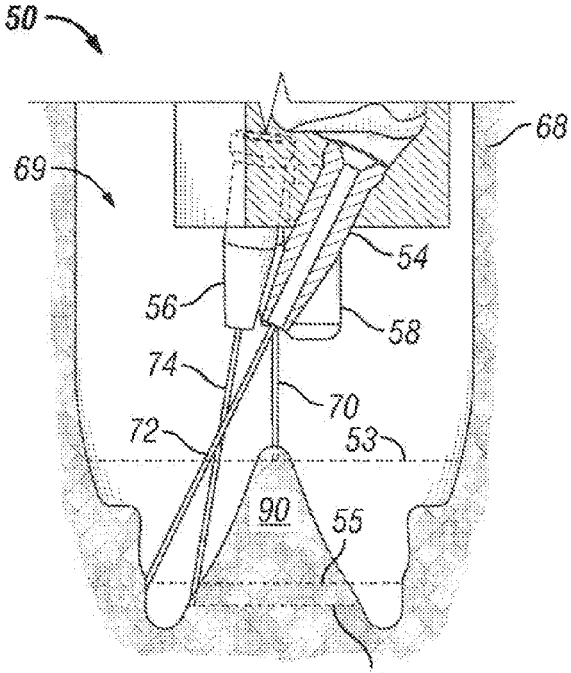
Figures 1, 7E:
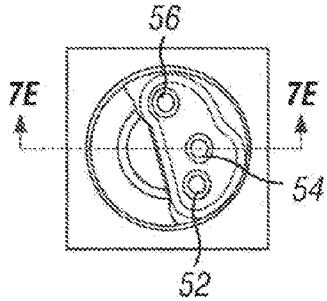
Figure 7F:
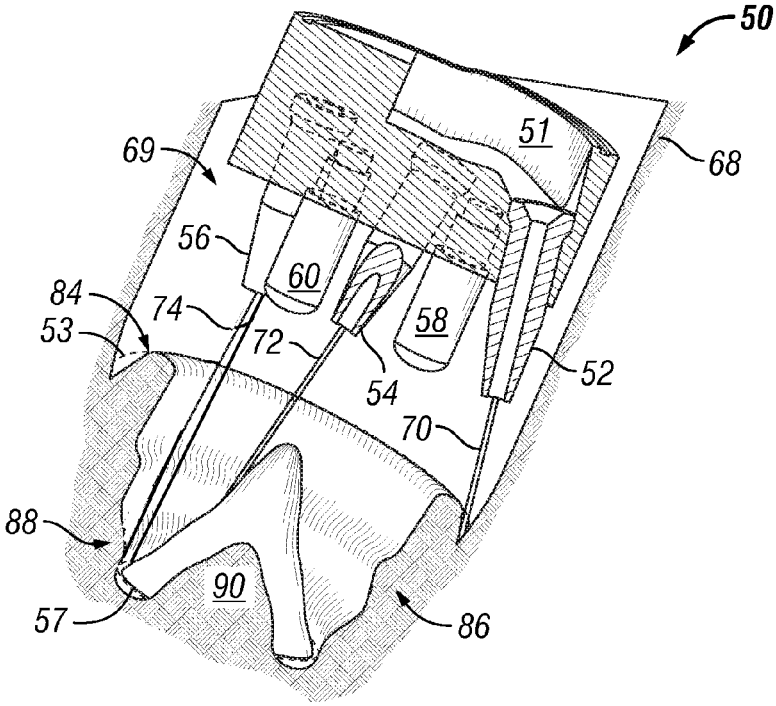

As best seen in FIG. 7F profile 84 represents an example of the borehole 69 bottom at another radial location in the borehole 69 during excavation. Thus an asymmetric borehole may be dynamically formed with the drill bit 50 as shown at any point in time but the finally formed wellbore 69 as seen in FIG. 7B will be fairly symmetrical.

Figure 8A:
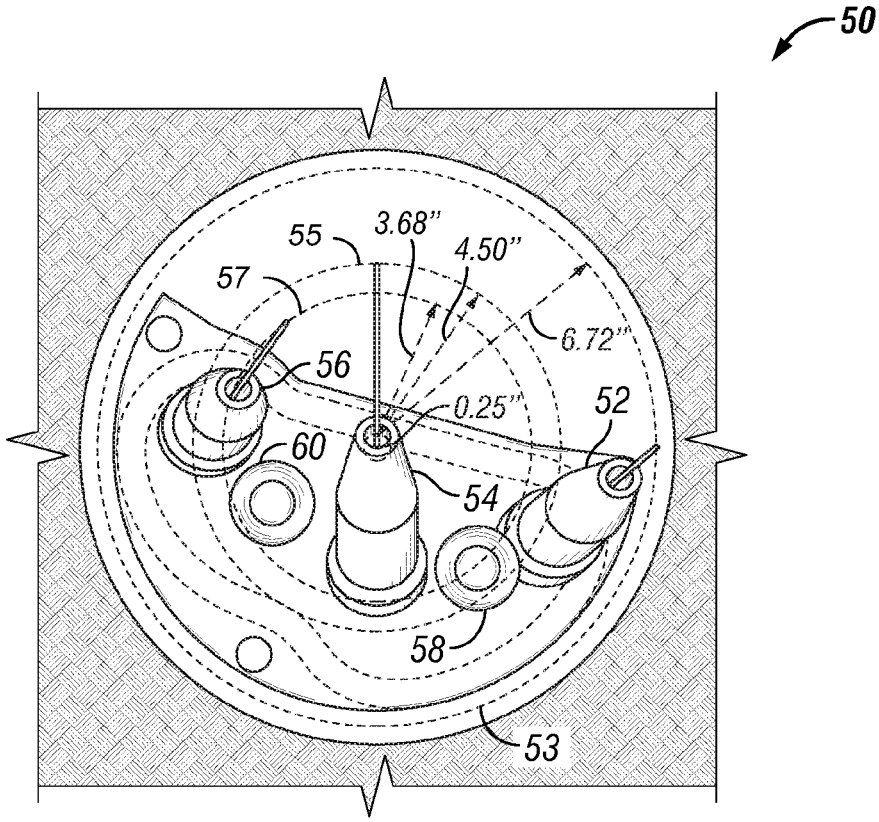
FIGS. 8A-8B illustrate lower and side views of the bit of FIG. 6.
Figure 8B:
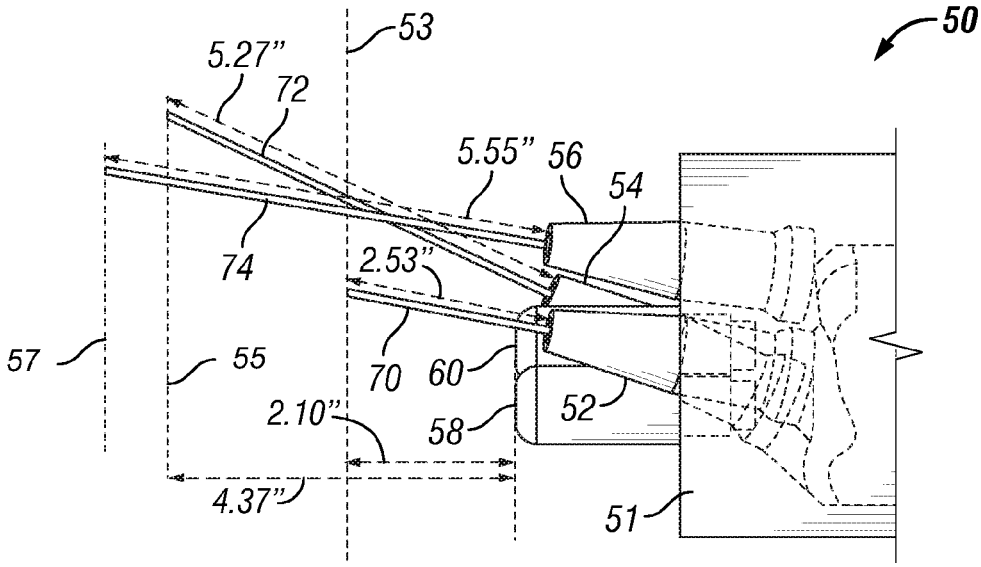

FIG. 7C is a sectional view (taken along lines 7C-7C of FIGS. 7C-1) that illustrates the middle and center nozzles 54 and 56 in sectional view with their corresponding discharges 72, 74. The center nozzle discharge 74 is shown contacting and eroding the rock cone 90 and the middle nozzle discharge 72 is shown having removed formation material 68 from the channel 88 bottom. Referring to FIG. 7F, the radially offset bottom hole profile 84 illustrates a profile achieved while drilling. FIG. 7D, (taken along line 7D-7D of FIGS. 7D-1), depicts each nozzle 52, 54, 56 in side view along with their discharge streams 70, 72, 74. Also shown are the bottom hole paths 53, 55, 57 followed by the discharge streams 70, 72, 74 as the bit 50 is rotated. FIG. 7E is shown as a sectional view (taken along lines 7E-7E of FIGS. 7E-1) that illustrates center nozzle 54 in a sectional view and middle nozzle 56 in a side view. FIGS. 8A and 8B depict lower and side views of the bit 50 of FIG. 6. Nozzle 52, 54, 56 orientations along with their discharge streams 70, 72, 74 and stream paths 53, 55, 57 are provided in both FIGS. 8A and 8B.

Figure 9:
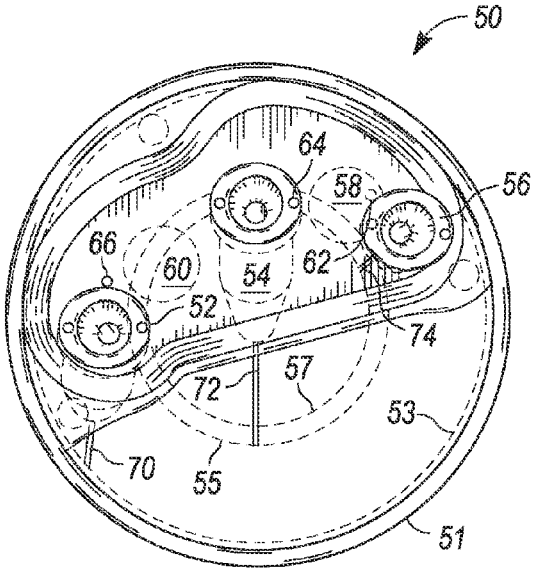
FIG. 9 is an overhead view of an excavating bit in accordance with the present disclosure.

FIG. 9 illustrates an overhead view of a bit 50 embodiment for use in excavating a borehole. The bit 50 directs pressurized slurry having fluid and particle impactors at a borehole bottom to fracture formation material. As described in more detail below, the pressurized slurry removes a portion of the borehole bottom to leave a profiled surface that contains a divot proximate the center axis of the bit 50. In the embodiment of FIG. 9, the location and direction of some of the nozzles are oriented such that the center nozzle now cuts the middle portion of the borehole and the middle nozzle now cuts the center portion of the borehole creating a divot near the center axis of the borehole. In the embodiment of FIG. 9, the bit 50 includes a bit body 51 and nozzles arranged within the bit body 51. More specifically, the nozzles include an outer nozzle 52 proximate to the body 51 wall, a center nozzle 56 approximately at the bit body 51 midsection, and a middle nozzle 54 also approximate at the bit body midsection but opposite the outer nozzle 52. As described herein, orientation includes each nozzle's alignment with respect to the bit axis $A_x$.

Further depicted in the embodiment of FIG. 9 are nozzle paths demonstrating where the slurry discharged from the nozzles 52, 54, 56 contacts the borehole 69 bottom. The paths include an outer nozzle path 53 formed by discharge from the outer nozzle 52; the outer nozzle path 53 is shown as a substantially circular path roughly aligned with the bit body 51 outer portion. Corresponding paths 55, 57 are formed respectively by the middle nozzle 54 and center nozzle 56. However, selective nozzle 52, 54, 56 orientation(s) within the bit body can affect the location and diameter of the nozzle paths. Additionally, while these paths 53, 55, 57 are shown as circular paths and symmetric about the body 51 axis, other arrangements are possible where paths may be asymmetric about the axis.

In an example configuration, the center nozzle 54 has a vertical tilt angle up to about 35°, and in one embodiment the nozzle's vertical tilt angle is 34.25°. The radial distance from the bit 50 axis $A_x$ to the middle nozzle 54 discharge can be about 0.247 inches. In another example, the center nozzle 56 has a vertical tilt angle of up to around −11°, where the negative value indicates it can tilt towards the bit 50 axis $A_x$. Optionally, the center nozzle 56 vertical tilt can be −10.17°. The center nozzle 56 can also have a lag of about 11.8° and discharge at about 3.03 inches from the bit 50 axis $A_x$. The outside nozzle 52 can be vertically tilted up to about 12° and in one example can be vertically tilted about 11.64°. The outside nozzle 52 can have a lead of about 10.99° and have a discharge of about 5.75 inches from the bit 50 axis $A_x$. For the purposes of discussion herein, vertical tilt and lead/lag denote an angle between a nozzle's discharge stream and a reference axis (such as the bit axis or borehole axis). The value for vertical tilt is the stream's component along a radial line from the reference axis to the nozzle base (where it attaches to the bit 50) and lead/lag is the stream's component along a line perpendicular to the radial line where it intersects the nozzle base.

Figure 10A:
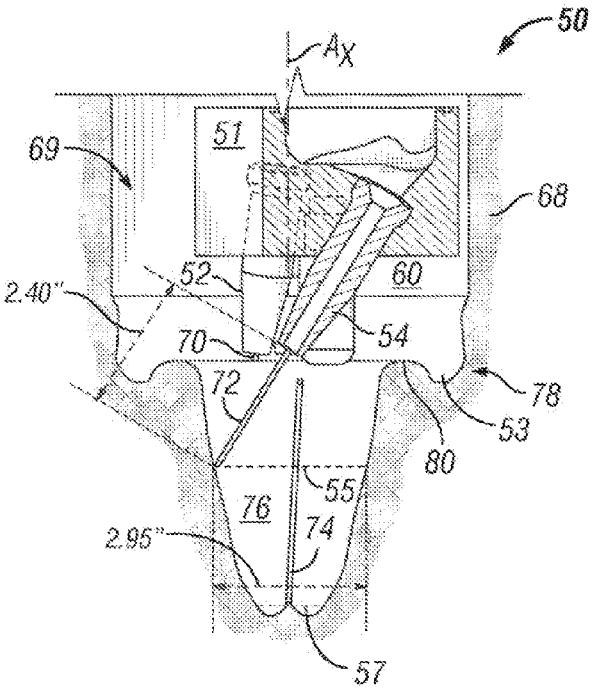
FIGS. 10A-10G illustrate lower and side views of the bit of FIG. 9, wherein those Figs. designating a "-1" show the sectional view for their corresponding Figure (for example.
Figures 1, 10A:
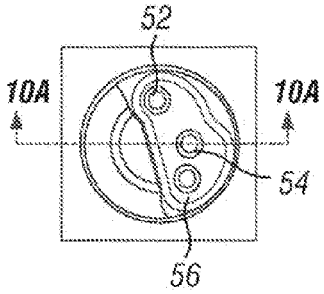

FIGS. 10A through 10E depict various sectional views of the bit 50 of FIG. 9, when the bit has rotated a complete 360° without advancement. Example profiles that form as bit 50 advances are seen in FIGS. 10F and 10G. FIGS. 10A-10E show the resulting paths after cutting. Referring now to FIG. 10A, the sectional view is taken along line 10A-10A of FIGS. 10A-1 bisecting the middle nozzle 54 and looks towards the center nozzle 56. Slurry is shown discharging from the center nozzle 56 forming a center nozzle discharge 74. Similarly, in FIG. 10B, the middle nozzle 54 discharges slurry in discharge 72. Referring back to FIG. 10A, middle nozzle path 55 and center nozzle path 57 as illustrated, are formed respectively by the center nozzle discharge 74 and middle nozzle discharge 72. The slurry discharges from the nozzles 52 and 54 impacts the formation 68 to form the profile in the borehole 69 at the bottom. The profile includes a trough 78 along the borehole outer circumference and a divot 76 surrounding the borehole axis $A_x$. A berm 80 separates the divot 76 and trough 78. The bit 50 configuration as illustrated provides an advantage of increased excavation efficiency.

By forming a divot 76 the borehole 69 midsection, more particle impactors strike the formation more proximate to orthogonally thus applying more of their kinetic energy to the formation. In contrast, impactors are more likely to strike a cone tangentially, which reduces the percent of energy transfer. Moreover, removing rock from the borehole 69 midsection relieves inherent rock stress from the surrounding rock. Accordingly, fewer impacts are required to excavate the rock surrounding the divot 76 thereby increasing the rate of penetration. In one example of use, more efficient excavating is realized with the embodiment of FIGS. 10A-10E by directing two of the nozzle discharge streams inward, one of which crosses the Axis $A_x$ and impacts the divot sidewall in an outwardly direction due to crossing the $A_x$ with one stream directed outwardly along the borehole periphery.

Figure 10B:
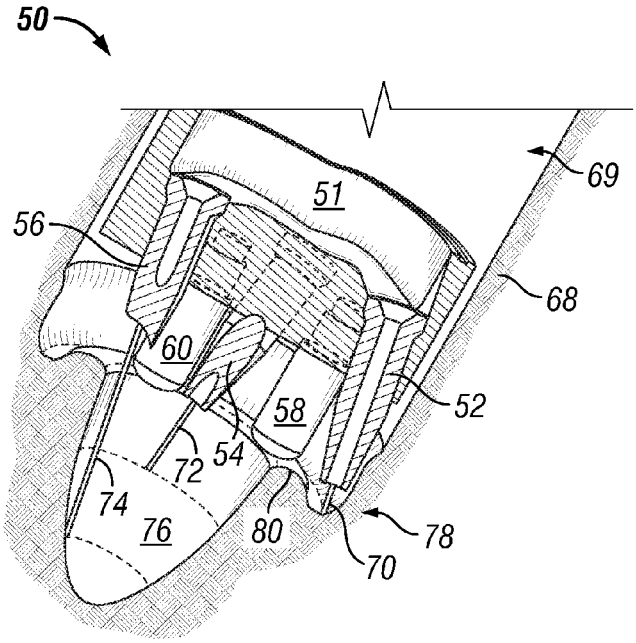
Figures 1, 10B:
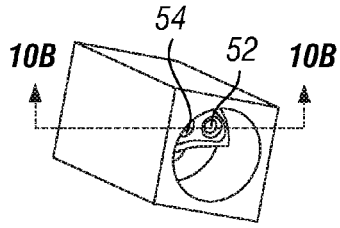
Figure 10C:
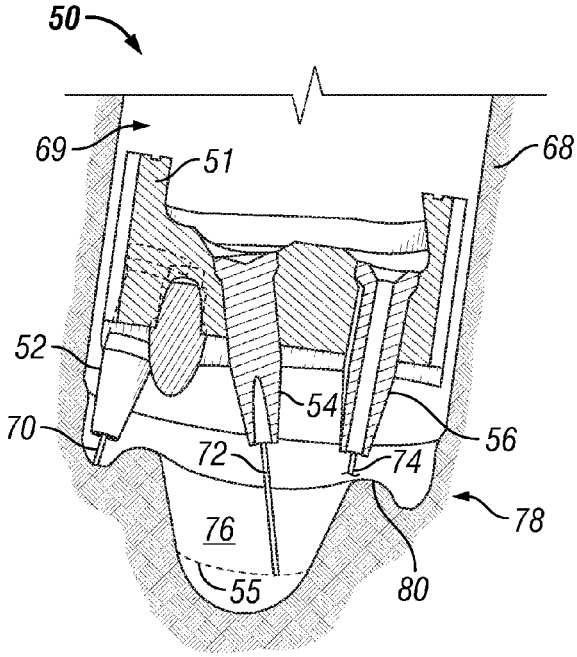
Figures 1, 10C:
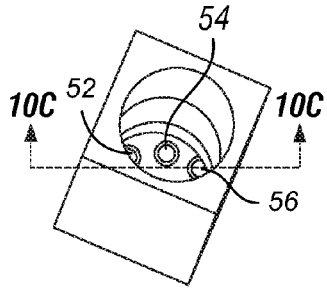

FIG. 10B is a side sectional view (taken along line 10B-10B of FIGS. 10B-1) which bisects the outer nozzle 52. In this view, each of the nozzles 52, 54, 56 are depicted in a sectional view. An outer nozzle discharge 70 is formed by slurry exiting the outer nozzle 52 and impinging the borehole 69 bottom to form the trough 78. The center nozzle discharge 74, which exits the center nozzle 56, contacts the center portion of the borehole 69 to form the divot 76. FIG. 10C is a sectional view (taken across line 10C-10C of FIGS. 10C-1) bisecting the center nozzle 56. The middle nozzle discharge 72 exits the nozzle 54 to excavate material from the upper portion of divot 76 on the berm 80 inner radius. The middle nozzle discharge 74, shown exiting nozzle 56, excavates the divot 76 lower center portion. The outer nozzle 52 directs the outer nozzle discharge 70 towards the borehole 69 outer radius and is shown forming the trough 78. An advantage of the nozzle arrangement of the bit 50 is illustrated by the angle between the nozzle discharges 74, 72 (FIG. 10A) and a borehole 69 surface. Referring to FIG. 10A, the borehole 69 surface contacted by the nozzle discharge 72 describes the divot 76 sidewall. As shown, the angle between the discharge 72 and the borehole 69 surface is at least about 45°. In contrast, the contact angle between the discharge 72 and borehole 69 surface of the arrangement of FIG. 7B is substantially smaller. This results in the discharge 74 contacting the borehole 69 bottom with a glancing blow thereby reducing excavating efficiency. Similarly, differences in contact angles are seen between discharges 70, 74 of FIGS. 10B and 10C and discharge 70, 74 of FIG. 7B.

Figure 1:
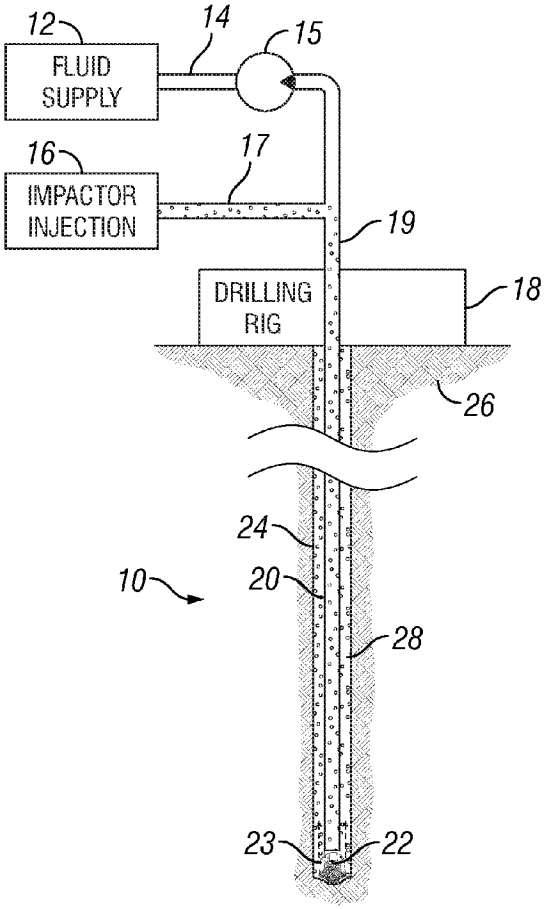
FIG. 1 (Prior Art)
FIG. 1 is a schematic view of a prior art excavation system.
Figure 4:
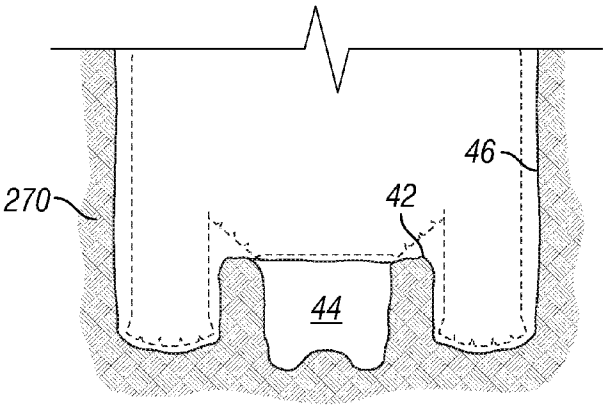
FIG. 4 (Prior Art)
FIGS. 3-5 illustrate in cross section examples of a bit of FIG. 1 forming a rock ring.
Figure 5:
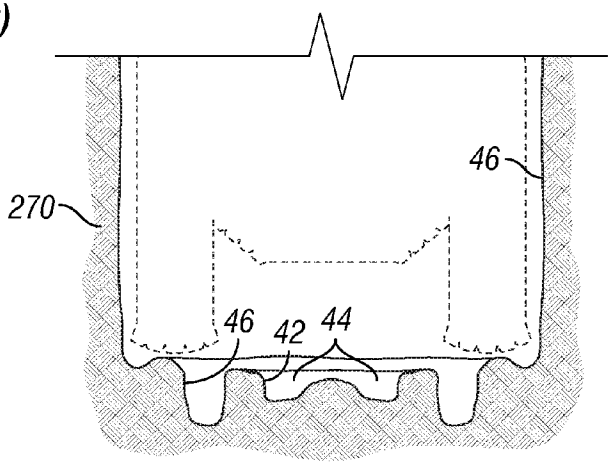
FIG. 5 (Prior Art)
Figure 3:
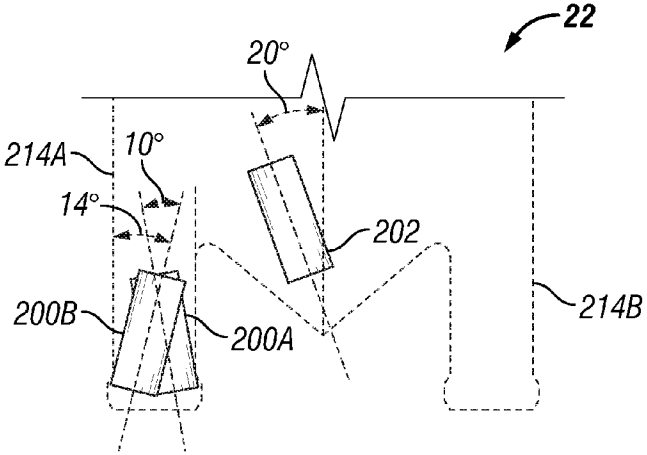
FIG. 3 (Prior Art)
Figure 10D:
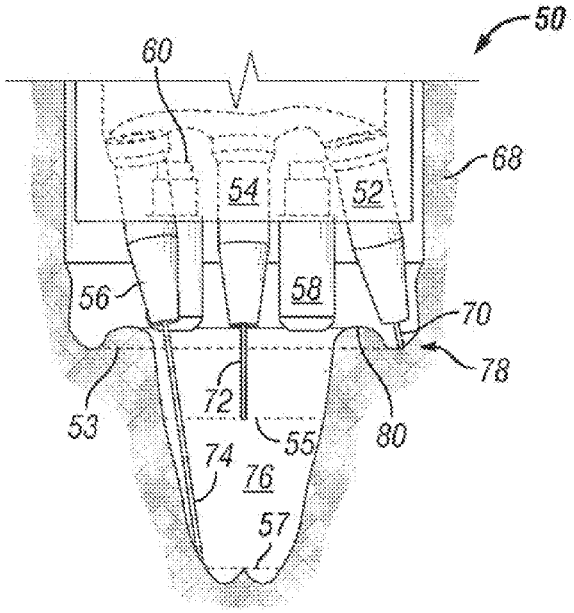
Figures 1, 10D:
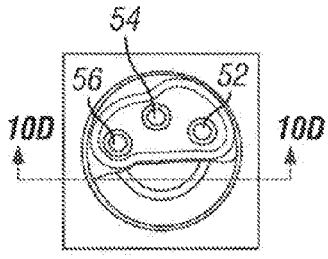
Figure 10E:
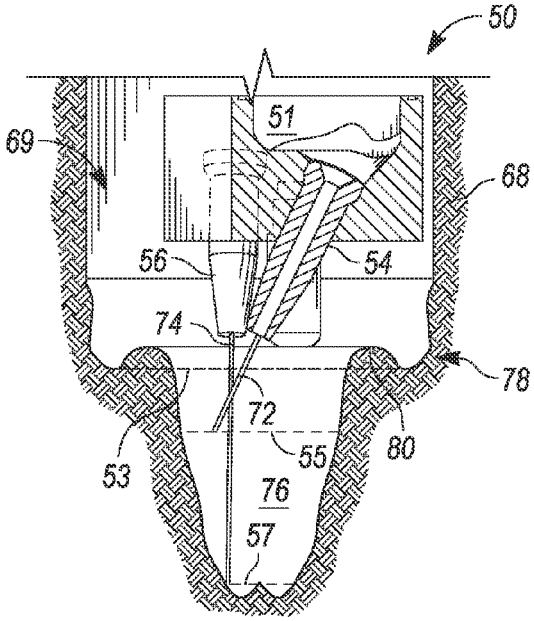
Figures 1, 10E:
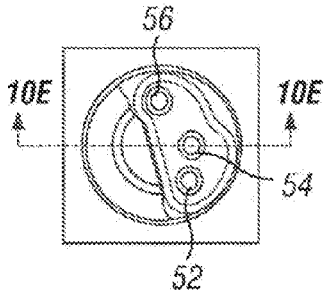
Figure 10F:
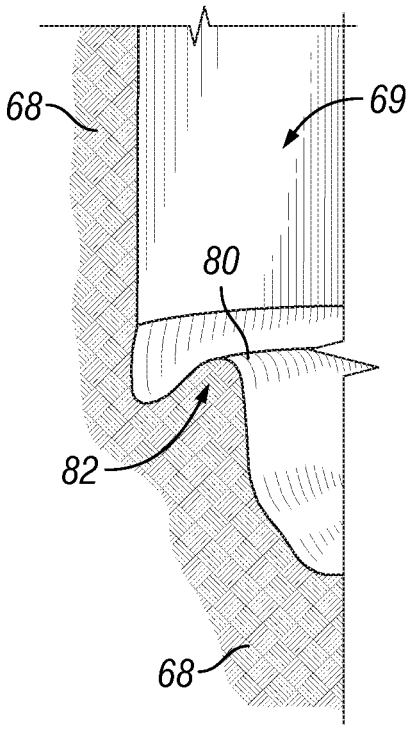
Figure 10G:
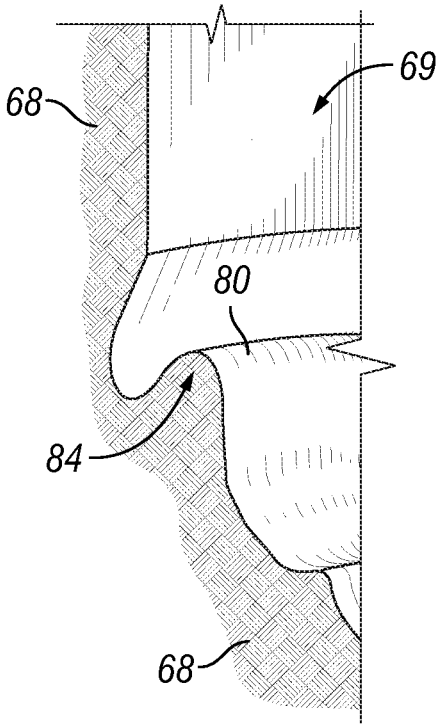

FIG. 10D is a sectional view (taken along lines 10D-10D of FIGS. 10D-1) bisecting the borehole 69 in a front plane view. Here, the outer nozzle discharge 70 is shown forming the trough 78 in the borehole 69 bottom outer radius. Rotating the bit 50 directs the outer nozzle discharge 70 along path 53. Also shown are the nozzle discharges 72, 74 forming the divot 76 directed along paths 57, 55. A sectional view of the borehole 69 along lines 10E-10E of FIG. 10E-1 is showing in FIG. 10E, which is 90° to the view in FIG. 10D. This view illustrates the center and middle nozzles 54, 56 and their respective discharges 72, 74 cooperating to form the divot 76. Nozzle discharge 72 contacts the upper portion of the divot 76 in a radially outward direction whereas nozzle discharge 74 contacts the lower center portion of the divot 76 in a radially inward direction illustrated in FIG. 10D and FIG. 10E further illustrating that the nozzle discharges 72, 74 trajectories' cross over one another.

Figure 11:
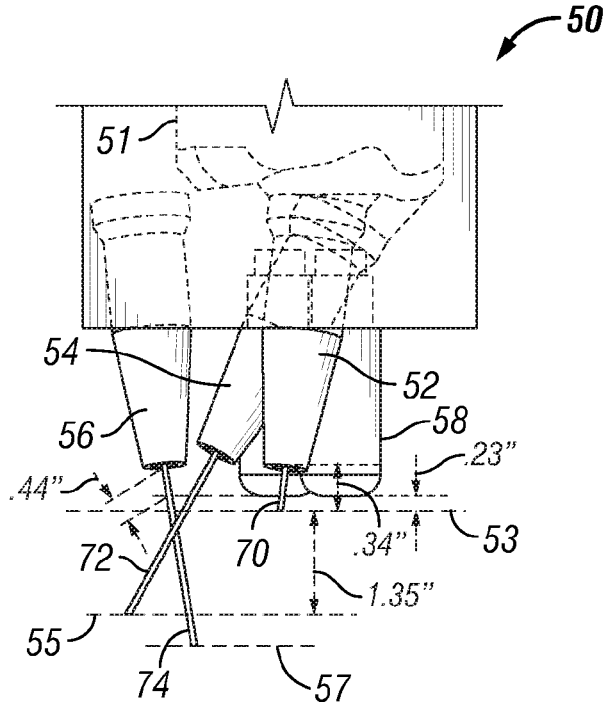
FIG. 11 illustrates lower and side views of the bit of FIG. 9.

Further shown in FIGS. 10F and 10G are profiles 82, 84 of formation 68 representing borehole 69 bottom configurations as formed during stages of excavation. The profile is continually formed dynamically throughout each rotation. The profile will be different at each section representing a specific radial point on the diameter through the centerline if the rotation is stopped. At each radial point the profile will be different as shown in FIGS. 10F and 10G. FIG. 11 illustrates side view of the embodiment of the bit of FIGS. 9 through 10E. FIG. 11 provides an example of the bit's 50 nozzle arrangement and spatially depicts the flow paths 53, 55, 57 after the bottomhole is formed. Also illustrating the nozzle discharges 72 and 74 cross over each other.

Figure 12B:
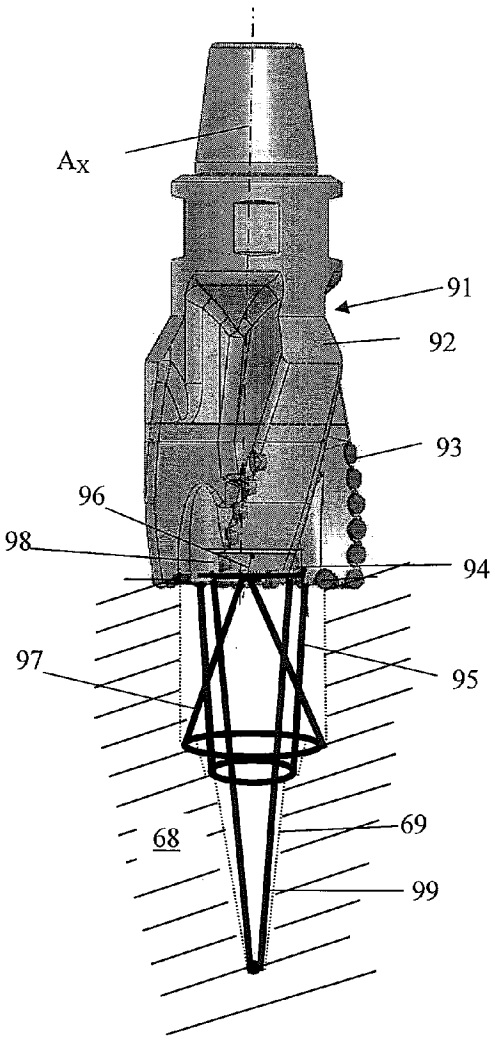
FIG. 12B depicts in side perspective view, alternate examples of excavating a borehole with frusto-conical sprays discharged from a bit nozzles as described herein.
Figure 12A:
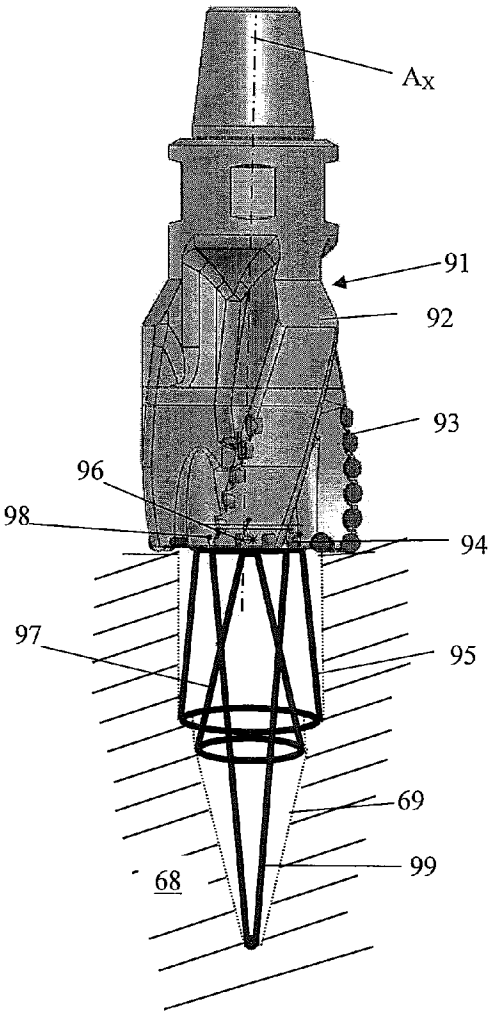
FIG. 12A portrays in side perspective view, examples of excavating a borehole with frusto-conical sprays discharged from a bit nozzles as described herein.

Shown in a side view in FIG. 12A is an example of a bit 91 excavating a borehole 69 through formation 68. The bit 91 includes a body 92 having cutters 93 arranged on a cutting face. The body 92 is provided with an outer nozzle 94 shown offset from the bit axis $A_x$ and on the bit body 92 lower facing surface. The nozzle 94 is angled so that its discharge is also angled with respect to the bit axis $A_x$. In an example of use, the bit 91 is rotated as the discharge exits the bit 91 to produce an annular frusto-conical pattern 95. Additionally, a center nozzle 96 and middle nozzle 98 are shown on the bit body 92. These nozzles are also angled so their respective discharges each form annular frusto-conical patterns 97, 99. As shown, the center nozzle 96 is closer to the bit axis $A_x$ than the middle nozzle 98. Moreover, the discharge exiting the center nozzle 96 is directed radially outward from the bit axis $A_x$ whereas the discharge is directed radially inward so that conical pattern 97 intersects with discharge conical pattern 99. It should be pointed out that the lower terminal end of the patterns 95, 97, 99 of FIG. 12A is provided as an example of bit 91 performance and can change depending on operational variables, such as formation properties and flow in each discharge.

Alternatively, as shown in a side view in FIG. 12B, the center and outer nozzles can be oriented to form respective intersecting spray patterns. As shown, the path where the center nozzle discharge stream 97 contacts the formation 68 circumscribes the path followed by corresponding outer nozzle discharge stream 95.

Figure 13:
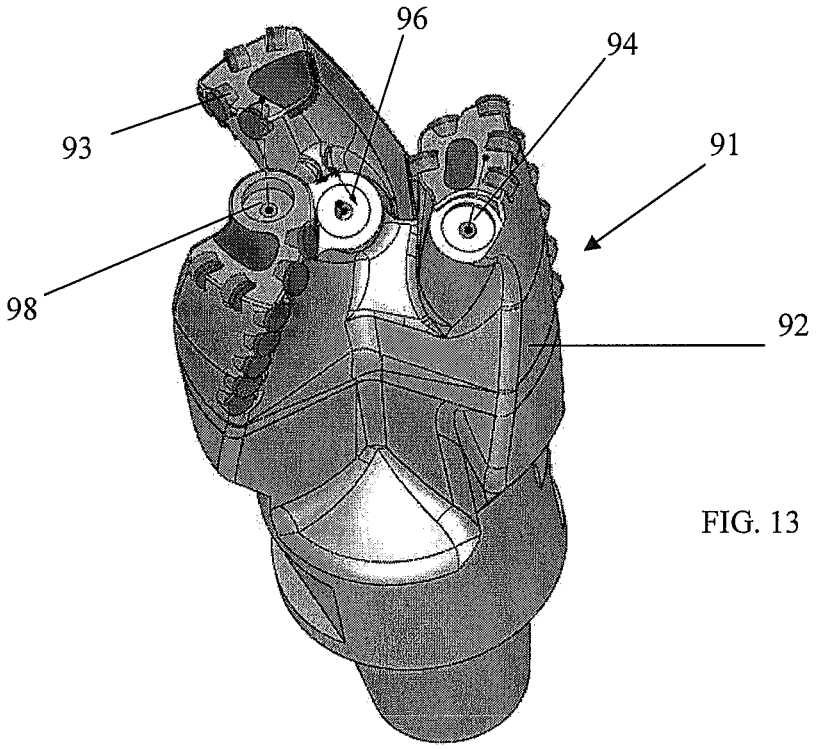
FIGS. 13 and 14 are lower perspective views of the bit of FIG. 12A.
Figure 14:
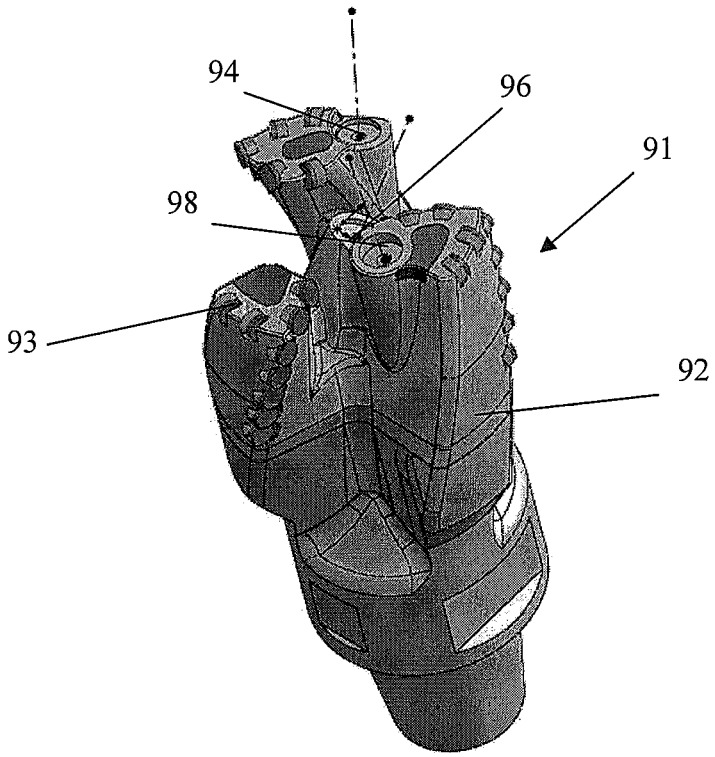

FIGS. 13 and 14 are lower perspective views of the bit 91 of FIG. 12A. In the embodiment shown, the bit 91 includes three legs downwardly depending from the bit body 92. The outer and middle nozzles 94, 98 are respectively provided within two of the legs and the center nozzle 96 is on the bit body 92 between the legs. The cutters 93, which can be PDC cutters, are shown on the lower cutting surface of the legs and laterally disposed along the legs.

At the time of the filing of the current document, a 97/8" design has been conceived, consistent with the above teachings, in which more than one nozzle is oriented in a "cross-fire" orientation, but such a design has not yet been tested.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes and/or substitutions are intended to be included within the scope of this disclosure as defined in the following claims. In the claims, means-plus-function clauses are intended to cover the structures described herein as performing the recited function and not only structural equivalents, but also equivalent structures.

What is claimed is:

1. A method of excavating a borehole through a subterranean formation comprising:

(a) pumping a supply of drilling fluid with a pump to supply a pressurized drilling circulating fluid to a drill string;

(b) adding impactors to the pressurized drilling circulating fluid downstream of the pump to form a pressurized impactor laden slurry;

(c) providing a circulating flow for excavating the borehole by directing the pressurized impactor slurry to the drill string in the borehole that has a drill bit connected to a lower end of the drill string in fluid communication with the drill string;

(d) rotating the drill bit about an axis;

(e) discharging a first pressurized impactor slurry spray from a first nozzle on the drill bit that is in fluid communication with the drill string, obliquely angled in at least one plane with respect to the axis and orbits about the axis with drill bit rotation to trace a first path in the borehole; and (f) discharging a second pressurized impactor slurry spray from a second nozzle on the drill bit that is in fluid communication with the drill string, obliquely angled in at least one plane with respect to the axis and orbits about the axis with drill bit rotation to trace a second path in the borehole, wherein the first discharge crosses over a vertical projection of the second borehole path and the second discharge crosses over a vertical projection of the first borehole path when the drill bit is rotated, such that the second borehole path circumscribes the first borehole path.

2. The method of claim 1, wherein the first borehole path has a diameter that ranges up to about 50% of a borehole diameter.

3. The method of claim 2, further comprising forming a semi-elliptical shaped divot in the borehole defined by the first discharge along the first borehole path.

4. The method of claim 3, further comprising contacting a side wall of the divot with the second discharge wherein the second discharge defines a second annular frusto-conical spray pattern after at least one revolution of the drill bit that has an increasing cross section with a distance away from the drill bit.

5. The method of claim 4, further comprising discharging a third pressurized impactor slurry spray from a third nozzle on the drill bit that is in fluid communication with the drill string, obliquely angled in at least one plane with respect to the axis and orbits about the axis with drill bit rotation to trace a third path in the borehole that circumscribes the first borehole path.

6. The method of claim 3, further comprising contacting a side wall of the divot with the second discharge wherein the second discharge defines a second frusto-conical spray pattern after at least one revolution of the drill bit that has a decreasing cross section with distance away from the bit.

7. The method of claim 6, further comprising discharging a third pressurized impactor slurry spray from a third nozzle on the drill bit that is in fluid communication with the drill string, obliquely angled in at least one plane with respect to the axis and orbits about the axis with drill bit rotation to trace a third path in the borehole that circumscribes the first borehole path.

8. The method of claim 1, wherein the and second borehole path has a diameter that ranges up to about 55% of a borehole diameter.

9. The method of claim 1, further comprising discharging a third pressurized impactor slurry spray from a third nozzle on the drill bit that is in fluid communication with the drill string, obliquely angled in at least one plane with respect to the axis and orbits about the axis with drill bit rotation to trace a third path in the borehole and directing from about 40% to about 67% of the impactor slurry spray discharged from the drill bit into contact with an area in the formation extending from a borehole wall inward up to about 55% of a borehole diameter.

10. The method of claim 1, wherein the first and second nozzles are each respectively angled from about −15° to about 35° with respect to the drill bit axis.

11. The method of claim 1, further comprising rotating the drill bit about a line offset from the drill bit axis.

12. The method of claim 1, wherein the angle of the first nozzle is oriented to direct the first discharge toward the drill bit axis and the angle of the second nozzle is oriented to direct the second discharge away from the drill bit axis such that the first discharge crosses over the vertical projection of the second borehole path and the second discharge crosses over the vertical projection of the first borehole path when the drill bit is rotated, such that the second borehole path circumscribes the first borehole path.

13. A system for excavating a borehole through a subterranean formation comprising:

a supply of pressurized impactor laden slurry;

a drill string in a borehole in communication with the supply;

a drill bit connected to a lower end of the drill string, the drill bit including an axis;

a first nozzle on the drill bit in fluid communication with the drill string and obliquely angled in at least one plane with respect to the drill bit axis so that a first discharge of the slurry from the first nozzle traces a first path in the borehole when the drill bit is rotated; and a second nozzle on the drill bit in fluid communication with the drill string and obliquely angled in at least one plane with respect to the drill bit axis so that a second discharge of the slurry from the second nozzle traces a second path in the borehole when the drill bit is rotated, wherein the first discharge crosses over a vertical projection of the second borehole path and the second discharge crosses over a vertical projection of the first borehole path when the drill bit is rotated, such that the second borehole path circumscribes the first borehole path.

14. The system of claim 13, further comprising a third nozzle on the drill bit in fluid communication with the drill string and obliquely angled in a plane with respect to the drill bit axis.

15. The system of claim 14, wherein the first nozzle is oriented at an angle having an absolute value of up to about 35° tilt with respect to the drill bit axis.

16. The system of claim 14 wherein the second nozzle is oriented at an angle having an absolute value of up to about 12° tilt with respect to the drill bit axis and at an angle having an absolute value of about 11° lead/leg with respect to a radial line defined between the drill bit axis and the second nozzle.

17. The system of claim 14 wherein the third nozzle is oriented at an angle having an absolute value of up to about 11° tilt with respect to the drill bit axis and at an angle having an absolute value of about 12° lead/leg with respect to a radial line defined between the drill bit axis and the third nozzle.

18. The system of claim 13, wherein the first discharge defines a first annular frusto-conical spray pattern after at least one revolution of the drill bit that has a decreasing cross section with distance away from the bit.

19. The system of claim 13, wherein the second discharge defines a second annular frusto-conical spray pattern after at least one revolution of the drill bit that has an increasing cross section with distance away from the bit.

20. The system of claim 13, wherein the second discharge defines a second annular frusto-conical spray pattern after at least one revolution of the drill bit that has a decreasing cross section with distance away from the bit.

21. The system of claim 13, wherein the angle of the first nozzle is oriented to direct the first discharge toward the drill bit axis and the angle of the second nozzle is oriented to direct the second discharge away from the drill bit axis such that the first discharge crosses over the vertical projection of the second borehole path and the second discharge crosses over the vertical projection of the first borehole path when the drill bit is rotated, such that the second borehole path circumscribes the first borehole path.

22. A drill bit for subterranean excavations comprising:

a drill bit body having a distal end and a proximal end adapted to be positioned on connected to a lower end of a drill string when disposed in a borehole in a subterranean formation, the drill bit body including a drill bit axis;

a first nozzle connected to and extending outwardly from the distal end of the drill bit body and positioned on the drill bit body to be in fluid communication with the drill string when the drill bit is connected thereto, the first nozzle also being obliquely angled in at least one plane with respect to the drill bit axis so that a first discharge of pressurized impactor laden slurry from the first nozzle traces a first path in the borehole when the drill bit body is rotated; and a second nozzle connected to and extending outwardly from the distal end of the drill bit body, spaced apart from the first nozzle, and positioned on the drill bit body to be in fluid communication with the drill string when the drill bit is connected thereto, the second nozzle also being obliquely angled in at least one plane with respect to the drill bit axis so that a second discharge of pressurized impactor laden slurry from the second nozzle traces a second path in the borehole when the drill bit body is rotated, wherein the first discharge crosses over a vertical projection of the second borehole path and the second discharge crosses over a vertical projection of the first borehole path when the drill bit is rotated, such that the second borehole path circumscribes the first borehole path.

23. The drill bit of claim 22, wherein the angle of the first nozzle is oriented to direct the first discharge toward the drill bit axis and the angle of the second nozzle is oriented to direct the second discharge away from the drill bit axis such that the first discharge crosses over the vertical projection of the second borehole path and the second discharge crosses over the vertical projection of the first borehole path when the drill bit is rotated, such that the second borehole path circumscribes the first borehole path.

* * * * *